US006375162B1

(12) United States Patent
Johnson

(10) Patent No.: US 6,375,162 B1
(45) Date of Patent: Apr. 23, 2002

(54) TRAILER TANDEM RELEASE LEVERAGE BAR

(76) Inventor: Darryl Gene Johnson, 1373 E. 86th Dr., Thornton, CO (US) 80229

( * ) Notice: Subject to any disclaimer, the term of this patent is extended or adjusted under 35 U.S.C. 154(b) by 0 days.

(21) Appl. No.: 09/505,825

(22) Filed: Feb. 17, 2000

(51) Int. Cl.[7] ..... B66F 3/00
(52) U.S. Cl. ..... 254/131
(58) Field of Search ..... 254/131, 132, 254/129, 30, 17, 113, 120; 294/17

(56) References Cited

U.S. PATENT DOCUMENTS 4,280,683 A * 7/1981 Knierim ..... 254/17
4,512,554 A * 4/1985 Racine ..... 254/131
4,991,893 A * 2/1991 Gordon et al. ..... 294/17
5,360,199 A * 11/1994 Speier ..... 254/129
5,907,940 A * 6/1999 Eddie ..... 254/131

* cited by examiner

*Primary Examiner*—Robert C. Watson

(57) ABSTRACT

The disclosed tool ("Trailer Tandem Release Leverage Bar"), is a unique and needed advance for the trucking industry. For use by all Operators (Truckers) that are tasked with adjusting the trailer tandem assembly. The trucking industry produced sliding trailer tandems to provide the ability to balance the vehicle weight accurately between the steering axle, driver axle(s), and the trailer axle(s). The mechanism used to lock the sliding trailer tandems customarily jams for many reasons including being frozen, rusty, or under the weight of the vehicle, and as such is difficult and sometimes impossible to be released or unlatched. Operators have historically had difficulty leaning under the trailer and exerting enough leverage to produce the necessary force to release the latch. The "Trailer Tandem Release Leverage Bar" as a new invention will allow the operator to release the latching pins without physical strain and difficulty. By giving the Operator (Trucker) added leverage, the "Trailer Tandem Release Leverage Bar" will make releasing the locking pins extremely easy and also reduce the risk of operator injury.

1 Claim, 2 Drawing Sheets

TRAILER TANDEM RELEASE LEVERAGE BAR

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

Field of Invention: The "Trailer Tandem Release Leverage Bar" is applicable to the General Transportation industry and specifically Trucking. Trailers have dual/Tandem axles, that can be moved on trailer models equipped with "sliding tandems". It is necessary to be able to move (slide) the tandem at least every time the trailer is loaded (frequently as twice weekly), to ensure properly balanced vehicle weight. These tandem axles will slide forward and backward along the trailer bottom. This results in a shift or repositioning of the vehicle weight distributed along the weight bearing axles (steering axle, driver axles, and trailer tandem axles). The sliding mechanism is held in place by a system of pins that when in-place bear the entire weight and force of the vehicle. This combined with the fact that the pins can become rusty, and or frozen by undercarriage moisture or spray, creates the necessity for the "Trailer Tandem Release Leverage Bar". Frequently, the pins become jammed and virtually impossible for the operator to retract. This invention will give the operator leverage and allow the pins to be retracted with minimal effort and risk of injury from over exertion and strain. This innovation, by providing the operator necessary leverage will serve to reduce road damage and therefore government road repair related to road use by vehicles with improperly balanced weights.

BRIEF SUMMARY OF THE INVENTION

There are Combination Trailers (18 wheelers) that have adjustable Tandem Axles. These Axles are held in-place by a locking pins. These pins bear the weight of the vehicle. Often, due to the extreme forces placed upon this locking mechanism, and or due to the pins becoming rusted tight or frozen the release mechanism becomes jammed. Additionally, the handle to release the locking mechanism is located under the trailer in a position that does not lend the operator much leverage to pull the latch mechanism out. The Trailer Tandem Release Leverage Bar will assist the operator by providing leverage and therefore minimizing the amount of force necessary to pull the pin out for tandem axle adjustment.

BRIEF DESCRIPTION OF THE SEVERAL VIEWS OF THE DRAWING

FIG. (1): "Trailer Tandem Release Leverage Bar" components.

FIG. (2): "Trailer Tandem Release Leverage Bar" fully assembled.

DETAILED DESCRIPTION OF THE INVENTION

Use/Operation:

The operator will loop the chain around the tandem axle release handle locking the end of the chain (Hook) on one of the chain links toeing/butting the shorter end of the Trailer Tandem Release Leverage Bar (with heavy rubber stopper) on the side of the trailer in a manor that produces an angle on bar. The operator will then apply pressure to the bar against the angle. This will exert excessive/necessary torque to the tandem release handle to cause it to release. At this point the operator will be free to adjust the trailer tandem as necessary. This mechanism (tool) enables the operator to effortlessly release the tandem release handle without applying pressure bent under the trailer in an awkward position at risk of serious back injury.

Operation Steps:

1. Loop chain (hook end) around the tandem release handle under trailer.
2. Latch hook through link of chain that allows operator to stretch to side of trailer.
3. Butt/Toe the shorter end of Leverage Bar on the side of the trailer.
4. Apply pressure on Leverage Bar to release locking handle.
5. Remove "Trailer Tandem Release Leverage Bar".

Materials:

1. Bolt: (qty 1).
2. Locking Nut: (qty 1).
3. Washer: (qty 1).
4. Washer: (qty 1).
5. Chain: (qty 1).
6. Hook: (qty 1).
7. Cotter Pin: (qty 1).
8. Steel Plate: (qty 1).
9. Steel or Galvanized Pipe: (qty 1).
10. HandGrip: (qty 1).
11. Heavy Rubber tip: (qty 1).

Construction:

1. Weld Plate to steel bar.
2. Cut ⅜ DIA Hole into Plate.
3. Attach/secure chain to hook with Cotter Pin/Lock.
4. Attach chain to steel plate with Bolt, Washers and Locking Nut (allows the chain to swivel).
5. Paint entire mechanism high visibility color.
6. Attach Rubber handles and stopper to the end of the Bar.

Figure 1:
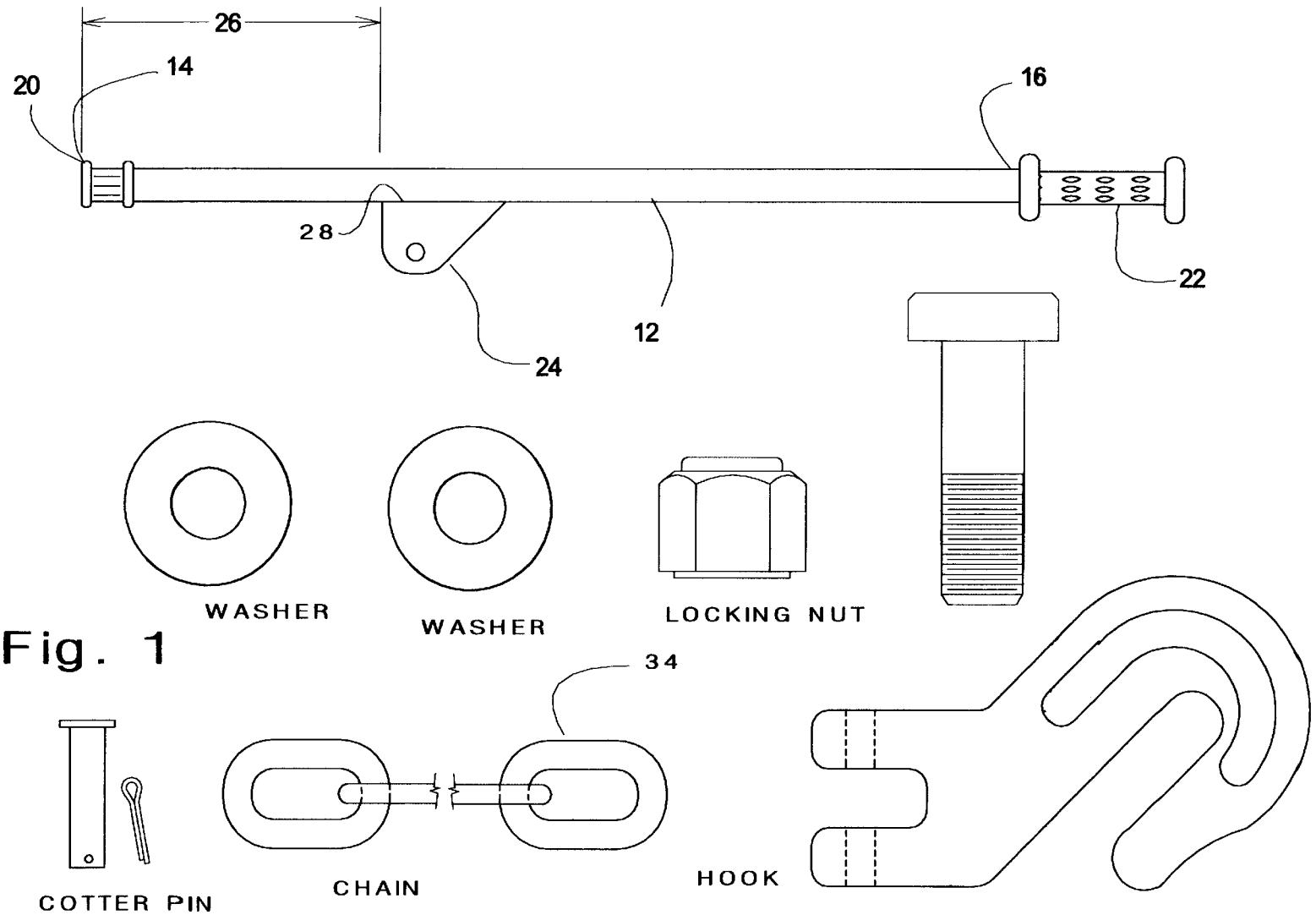
Figure 2:
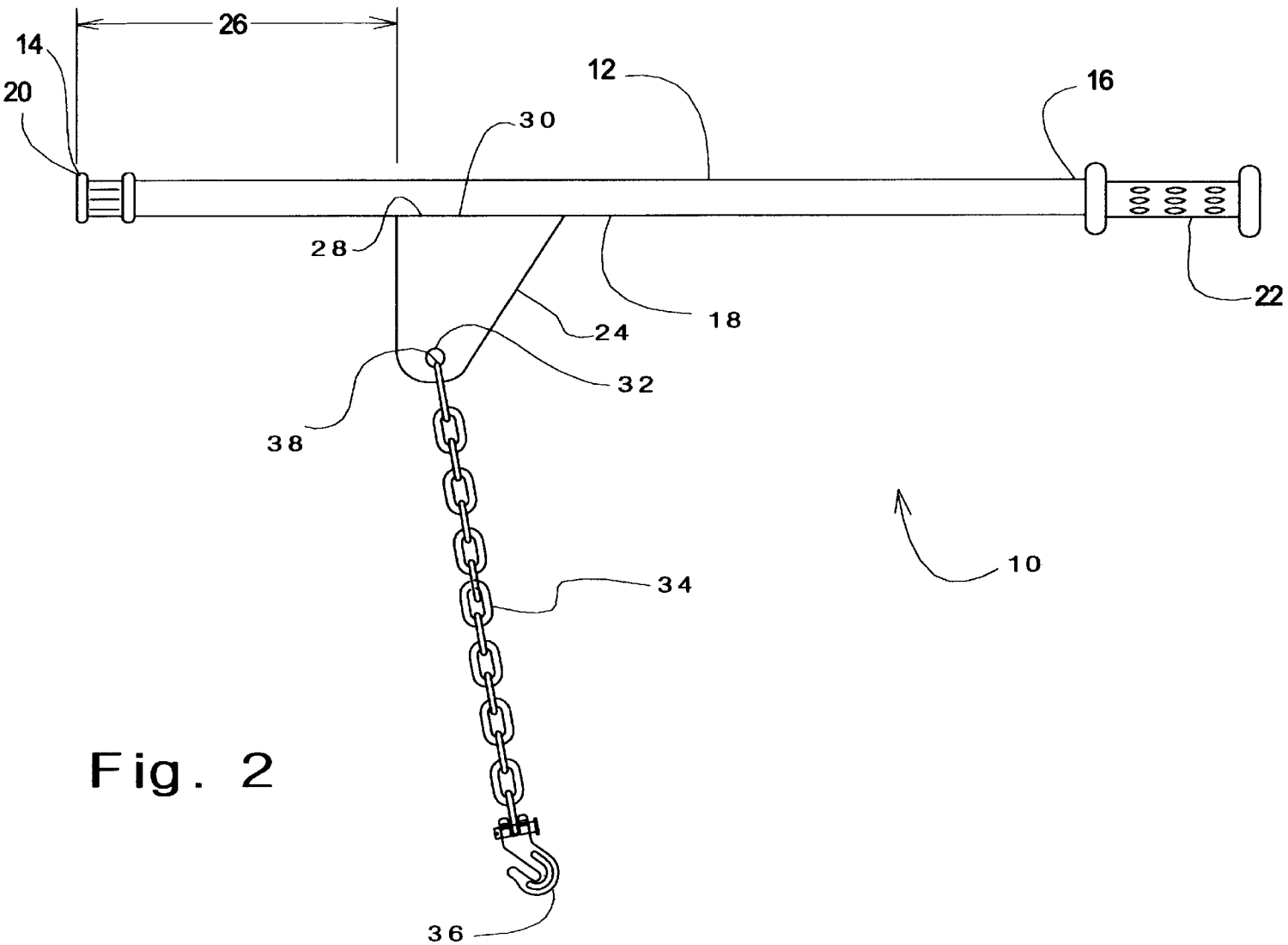

Thus, FIGS. 1 and 2 show a leverage tool 10 for releasing a locking pin for a sliding tandem of a trucking tandem trailer. The leverage tool 10 includes a rigid elongated body 12 that has having a first end 14, a second end 16, and a mid-portion 18. The first end 14 includes a resilient foot 20 that is made of a material such as rubber. The second end 16 includes a grip handle 22. Attached to the elongated body 12 is a rigid cam lever 24 that projects from the elongated body 12 at a distance 26 from the first end 14 of the elongated body 12. The cam lever 24 will be positioned at a location 28 between the mid-portion 18 of the elongated body 12 and the first end 14 of the elongated body 12. Also illustrated is that the rigid cam lever 24 will include a base 30 and a connector 32. The connector 32 being spaced from the base of approximately one-half of the distance 26 of the location of the first end 14 of the elongated body 12 from the base of the rigid cam lever 24. Additionally, a flexible tension member 34, which in this example is a chain, is attached to the connector 32. The flexible tension member 34 includes a lever engagement end 36 and a rigid cam connection end 38. The flexible tension member 34 will preferably extend from the connector 32 of the rigid cam lever 24, so that on engaging the pin release lever with the flexible tension member 34, and positioning the resilient foot 20 near the pin release pin handle, on the underside of the tandem trailer, rotation of the grip handle 22 about the resilient foot 20 will cause the rigid cam 24 to transfer a tension load into the tension member 24, which is in turn transmitted to the pin handle by the rigid cam.

What is claimed is:

1. A leverage tool for releasing a locking pin for a sliding tandem of a trucking tandem trailer the tandem trailer having an underside below a load area on the tandem trailer, the locking pins being releaseable by pulling a pin handle that is connected to the locking pin, the locking pin and pin handle being located on the underside of the trailer, the leverage tool comprising:

a rigid elongated body having a first end and a second end, and a mid-portion, the first end having a resilient foot, the second end having a grip handle;

a rigid cam lever projecting from the elongated body at a distance from the first end of the elongated body, at a location between the mid-portion of the elongated body and the first end of the elongated body, the rigid cam lever having a base and a connector, the connector being spaced from the base a distance of approximately one-half of the distance of the location of the first end of the elongated body from the base of the rigid cam lever; and a flexible tension member the flexible tension member having a pin handle engagement end and a rigid cam connection end, the flexible tension member extending from the connector of the rigid cam lever, so that on engaging the pin handle with the flexible tension member, and positioning the resilient foot near the pin handle on the underside of the tandem trailer with the elongated body, rotation of the pin handle about the resilient foot will cause the rigid cam to transfer a tension load into the tension member, which is in turn transmitted to the pin handle by the rigid cam.

* * * * *